United States Patent [19]

Hallsworth et al.

[11] 4,246,676

[45] Jan. 27, 1981

[54] LIQUID COLLECTING VACUUM CONTAINER

[76] Inventors: Alexander Hallsworth; Gary Hallsworth, both of 308 Cypress Ave., Lindenwold, N.J. 08021

[21] Appl. No.: 66,810

[22] Filed: Aug. 15, 1979

[51] Int. Cl.[3] ..... A47L 9/10

[52] U.S. Cl. ..... 15/353; 55/215; 55/216

[58] Field of Search ..... 15/353, 320, 321; 55/215, 216

[56] References Cited

U.S. PATENT DOCUMENTS

| | | | |
|---|---|---|---|
| 1,982,345 | 11/1934 | Kirby | 15/321 |
| 2,889,846 | 6/1959 | Glasby et al. | 15/353 X |
| 3,029,463 | 4/1962 | Bishop | 15/353 |
| 3,896,520 | 7/1975 | Williams | 15/353 X |
| 4,041,569 | 8/1977 | Petersen | 15/353 |
| 4,080,104 | 3/1978 | Brown | 15/353 X |

FOREIGN PATENT DOCUMENTS

| | | | |
|---|---|---|---|
| 937312 | 9/1963 | United Kingdom | 15/353 |

*Primary Examiner*—Christopher K. Moore
*Attorney, Agent, or Firm*—Duffield & Lehrer

[57] ABSTRACT

An air and liquid tight liquid collecting container includes a cover which may be sealed to the top of the container. The cover includes an inlet port adapted to be connected to a hose which in turn carries a nozzle at the end thereof for picking up liquids. The cover also includes a vacuum port which is adapted to be connected to a standard vacuum cleaner. Associated with the vacuum port is a liquid level sensing device which opens the vacuum port to the atmosphere when the liquid rises to a predetermined level thereby preventing the liquid from entering the vacuum line. A pump, suspended from the cover into the container, pumps the liquid collected in the container to some external desired location.

6 Claims, 3 Drawing Figures

LIQUID COLLECTING VACUUM CONTAINER

BACKGROUND OF THE INVENTION

The present invention is directed toward a liquid collecting vacuum container and more particularly toward such a device which is adapted to be used with a conventional vacuum cleaner and which includes a safety feature to prevent liquid from entering the vacuum line and flowing toward the vacuum cleaner.

Most buildings and basements thereof are constructed so as to be totally waterproof. However, it is not uncommon for water to collect on the floors during unusually heavy rainy periods or for various other reasons such as a broken water pipe or the like. If the water is relatively deep, it must be pumped out with the use of a pump. For this reason, many buildings have sump pumps permanently installed.

Puddles of water cannot normally, however, be removed with the use of a pump. For this reason, vacuum cleaners have been designed which are capable of lifting the water from puddles and depositing it into a collecting container. These water vacuum cleaners have the same general appearance as a conventional home canister type vacuum cleaner and include a vacuum hose with a nozzle at the end thereof which is swept across the puddles on the floor.

These commercially available water vacuums normally perform satisfactorily. However, they can often be relatively expensive. In addition, when the container is filled with water it must be carried to some remote location to be emptied. This can be extremely difficult since the device with the vacuum motor in combination with the water can be extremely heavy.

SUMMARY OF THE INVENTION

The present invention is believed to overcome the problems of the prior art devices described above by providing an apparatus which does not include its own vacuum pump but which instead is intended to be used in conjunction with a standard home vacuum cleaner. This is accomplished by the present invention by the provision of an air and liquid tight liquid collecting container including a cover which may be sealed to the top of the container. The cover includes an inlet port adapted to be connected to a hose which in turn carries a nozzle at the end thereof for picking up liquids. The cover also includes a vacuum port which is adapted to be connected to a standard vacuum cleaner. Associated with the vacuum port is a liquid level sensing device which opens the vacuum port to the atmosphere when the liquid rises to a predetermined level thereby preventing the liquid from entering the vacuum line. A pump, suspended from the cover into the container, pumps the liquid collected in the container to some external desired location.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 1:
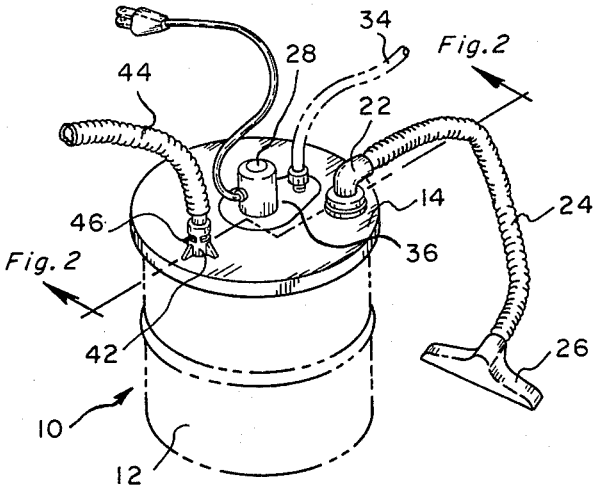
FIG. 1 is a perspective view of a liquid collecting vacuum container constructed in accordance with the principles of the present invention.
Figure 2:
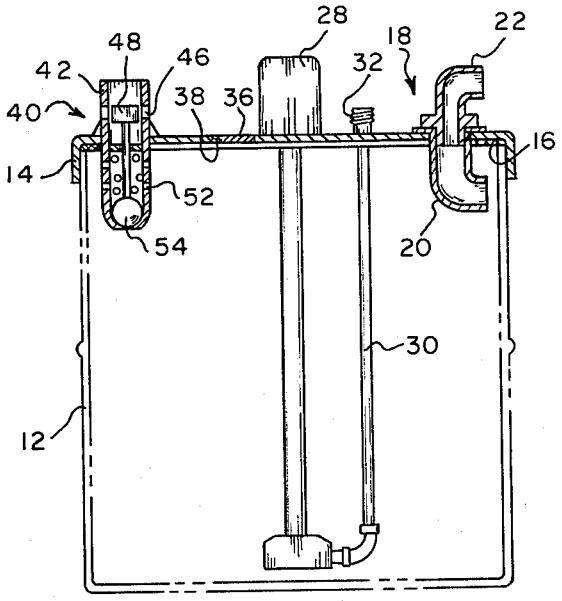
FIG. 2 is a cross sectional view taken along the lines 2—2 of FIG. 1.
Figure 3:
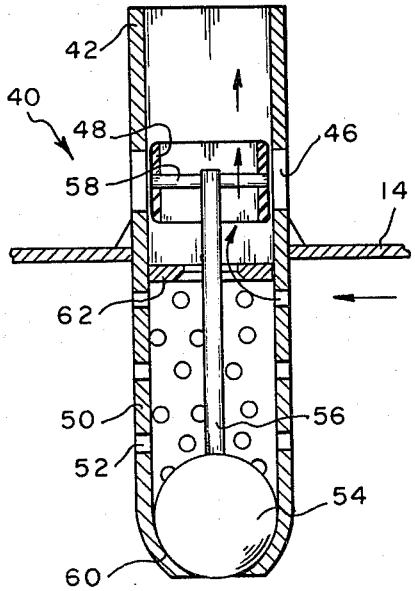
FIG. 3 is an enlarged cross sectional view of the vacuum port and liquid level sensing device shown in FIG. 2.

Referring now to the drawings in detail wherein like reference numerals have been used throughout the various figures to designate like elements, there is shown in FIG. 1 a perspective view of a water collecting vacuum container constructed in accordance with the principles of the present invention and designated generally as 10. The device 10 is comprised essentially of two main components: the container or receptacle 12 and the cover 14. The container or receptacle 12 is of conventional cylindrical shape and may in fact be comprised of a conventional utility bucket or the like. As shown most clearly in FIG. 2, the cover 14 rests on the top edge of the side walls of the container 12 and an airtight seal is formed there between by a sealing ring 16.

Cover 14 has an inlet port 18 adjacent one edge thereof. Inlet port 18 is comprised of a lower tubular portion 20 and an upper tubular portion 22. The upper tubular portion 22 is mounted in a known manner so as to be capable of rotating about the central axis thereof. As shown in FIG. 1, a hose 24 is adapted to be connected to the free end of the tubular element 22 of inlet port 18. The other end of the hose 24 is connected to a nozzle 26 which is adapted to be drawn across a puddle of water for picking up the same in a manner to be described hereinbelow.

Located substantially centrally of the cover 14 is a pump 28. Pump 28 is shown to be electrically operated although it is contemplated that other types of pumps may be utilized with the present invention. Pump 28 extends downwardly into the container portion 12 and is capable of pumping any liquid which is collected therein up through conduit 30 to the top surface of the cover 14 where conduit 30 terminates at a threaded terminal 32. Hose 34 which may be a conventional garden hose delivers the liquid pumped by the pump 28 to some desired remote location.

Pump 28 and the threaded terminal 32 are preferably mounted on a plate insert 36. Plate 36 fits into a complementary opening in the cover 14 and is vertically supported in the opening by the step-shaped peripheral edge thereof which cooperates with a complementary stepped opening as shown at 38 in FIG. 2. The purpose of the plate insert 36 is to allow the present invention to be used either with the pump 28 or without the same. If it is ever desired to utilize the invention without the pump, the pump is merely removed along with the plate 36 and another similarly shaped plate having no openings therein is inserted into the opening in the cover 14.

Located on the cover 14 at a position remote from the inlet port 18 is a vacuum port 40. Vacuum port 40 is substantially cylindrically shaped and includes an upper portion 42 which may be connected to a vacuum cleaner hose 44. While not shown, the free end of the hose 44 is connected to the vacuum side of a conventional home vacuum cleaner.

A plurality of apertures 46 pass through the side walls of the upper portion 42 of vacuum port 40. These apertures 46 are located at a position below the top of the vacuum port where the hose 44 is attached but above the top surface of the cover 14. Apertures 46 allow the interior of the vacuum port 40 to communicate with the atmosphere. However, these apertures 46 are normally closed by a hollow cylindrically shaped valve member 48.

The vacuum port 40 also extends below the surface of the cover 14 and includes a lower substantially cylindrically shaped portion 50. Portion 50 includes a plurality of holes 52 passing there through and includes therein a ball-shaped element 54 which has a relatively low specific gravity thereby making it relatively buoyant. Ball 54 is connected to the valve 48 by way of upstanding rigid rod 56 and crossbar 58. Accordingly, vertical movement of the ball 54 results in corresponding vertical movement of the valve 48.

The walls of the lower end of the cylindrically shaped lower portion 50 of vacuum port 40 are curved inwardly such as shown at 60 to retain the ball 54 therein. Located in the upper end of the lower portion 50 is a valve seat 62 which is adapted to cooperate with the ball 54 so as to totally seal the vacuum port when the ball is seated therein.

The present invention operates in the following manner. After the hoses 24, 34 and 44 are attached to their respective ports, the vacuum cleaner connected to the free end of hose 44 is turned on. As should be readily apparent to those skilled in the art, since the apertures 46 in the vacuum port 40 are closed, the low pressure being created by the vacuum in the hose 44 draws air out of the container 12. As the pressure in the container 12 drops, the cover 14 is more tightly sealed against the top edge of the container and similarly the plate 36 more tightly seals itself in the opening in the cover 14.

The low pressure or vacuum is transmitted through hose 24 to the nozzle 26. Thus, as the nozzle 26 is drawn or swept across a liquid puddle, liquid (and possibly air depending on the depth of the puddle) will be drawn up through the hose 24 and through the inlet port 18. Since the free end of the lower tubular portion 20 of inlet port 18 is bent toward the side wall of the container 12, liquid spray or droplets or the like will be directed toward the wall where they will lose their kinetic energy and fall to the bottom of the container 12. This will continue until liquid in the container 12 begins to rise to the level of the ball 54. At this point, the ball 54 will begin to rise and will, in turn, move the valve 48 upwardly. After a slight upward movement of the valve 48, the apertures 46 will be opened thereby allowing the interior of the upper portion 42 of the vacuum port 40 to communicate directly with the atmosphere. Thus, air will be drawn through the ports 45 and through the hose 44 to the vacuum source and the air pressure within the container 12 will rise. As a result, no further liquid will be drawn through the nozzle 26.

The purpose of the valve 48 is to prevent the liquid from rising to a point where it eventually is drawn through the hose 44 to the vacuum cleaner where it may cause substantial damage. If for some reason this safety feature fails such as by the apertures 46 being inadvertently blocked, the ball 54 will continue to move upwardly until it is firmly seated in the valve seat 62. At this point, the upper portion 42 of the vacuum port 40 no longer communicates with the interior of the container 12 and accordingly no further liquid will be drawn through the nozzle 26 into the container.

After the container 12 is filled or at substantially any time while it is being filled, the pump 28 may be activated. With the pump operating, the liquid collected in the container 12 will be pumped up through the conduit 30 and out through 34 to some remote location. This allows the device to be continuously operated. If the pump were not utilized, after the container were filled, the cover would have to be removed and the container 12 would have to be carried to some remote location to be emptied.

The present invention may be embodied in other specific forms without departing from the spirit or essential attributes thereof and accordingly reference should be made to the appended claims rather than to the foregoing specification as indicating the scope of the invention.

We claim:

1. A liquid collecting vacuum container comprising:

a liquid and airtight container;

a cover for said container and means for sealing said cover to said container;

an inlet port mounted on said cover and being adapted to be connected to a hose means;

a vacuum port means mounted on said cover, said vacuum port means including a substantially cylindrically shaped portion extending upwardly from the top of said cover and at least one aperture passing through a side wall of said cylindrically shaped portion at a portion above the top of said cover, said vacuum port means being adapted to be connected to a vacuum source at a point above said aperture, and a liquid level sensing means mounted on said cover beneath said vacuum port means, said liquid level sensing means including a ball float within said container, an elongated rod extending substantially vertically upwardly therefrom into said cylindrically shaped portion and a closure member carried by the upper end of said rod; said float, rod and closure member being movable in unison such that said aperture is closed by said closure member when liquid in said container is below a predetermined level and said closure member rises to open said aperture when the liquid level rises above said predetermined level.

2. The device as claimed in claim 1 further including a pump means carried by said cover, said pump means being adapted to pump liquid from said container.

3. The device as claimed in claim 2 wherein said pump means is removably connected to said cover.

4. The device as claimed in claim 3 wherein said pump means is mounted on a plate and wherein said cover includes an opening therein having a configuration complementary to the shape of said plate and being adapted to be closed by said plate.

5. The device as claimed in claim 4 including an additional plate adapted to close said opening in lieu of said first mentioned plate.

6. The device as claimed in claim 1 further including a valve seat within said liquid level sensing means at a position adjacent the bottom of said cover, said ball float being adapted to seat itself into said valve seat to thereby close communication between the interior of said container and said vacuum source whenever liquid within said container rises to a second and higher predetermined level.

* * * * *